US011641912B2

(12) United States Patent
Fiedler et al.

(10) Patent No.: US 11,641,912 B2
(45) Date of Patent: May 9, 2023

(54) CLOSURE DEVICE WITH CLOSURE PARTS WHICH CAN BE PLACED AGAINST EACH OTHER

(71) Applicant: Fidlock GmbH, Hannover (DE)

(72) Inventors: Joachim Fiedler, Hannover (DE); Lasse Hiller, Ronnenberg (DE)

(73) Assignee: Fidlock GmbH, Hannover (DE)

( * ) Notice: Subject to any disclaimer, the term of this patent is extended or adjusted under 35 U.S.C. 154(b) by 0 days.

(21) Appl. No.: 17/740,640

(22) Filed: May 10, 2022

(65) Prior Publication Data

US 2022/0265004 A1 Aug. 25, 2022

Related U.S. Application Data

(62) Division of application No. 17/277,345, filed as application No. PCT/EP2019/074855 on Sep. 17, 2019, now Pat. No. 11,425,968.

(30) Foreign Application Priority Data

Sep. 19, 2018 (DE) ..... 10 2018 123 026.5

(51) Int. Cl.
*A44B 11/25* (2006.01)

(52) U.S. Cl.
CPC ..... *A44B 11/2542* (2013.01); *A44B 11/2588* (2013.01); *Y10T 24/32* (2015.01)

(58) Field of Classification Search
CPC .. A44B 11/2588; A44B 11/2542; Y10T 24/32
See application file for complete search history.

(56) References Cited

U.S. PATENT DOCUMENTS

| | | | | |
|---|---|---|---|---|
| 4,982,581 | A | 1/1991 | Furuyama | |
| 5,572,887 | A | 11/1996 | Geswelli | |
| 2006/0096070 | A1* | 5/2006 | Ishida | A44C 5/2076 24/303 |
| 2008/0047111 | A1 | 2/2008 | Garber | |
| 2010/0283269 | A1 | 11/2010 | Fiedler | |
| 2011/0001025 | A1 | 1/2011 | Fiedler | |
| 2011/0030174 | A1 | 2/2011 | Fiedler | |
| 2011/0289737 | A1* | 12/2011 | Ninomiya | H01F 7/0263 24/303 |
| 2011/0298227 | A1* | 12/2011 | Fiedler | E05B 47/004 292/251.5 |

(Continued)

FOREIGN PATENT DOCUMENTS

| | | | |
|---|---|---|---|
| DE | 209153 | C | 4/1909 |
| DE | 102018201019 | A1 | 8/2018 |

(Continued)

*Primary Examiner* — Robert Sandy
*Assistant Examiner* — Michael S Lee
(74) *Attorney, Agent, or Firm* — The Webb Law Firm

(57) ABSTRACT

A closure device includes a first closure part which includes a base body and at least one closure element rotatably arranged on the base body about an axis of rotation. The at least one closure element includes a base body and at least one first locking portion arranged on the base body, and at least one second closure part which includes a base element and at least one second locking portion arranged on the base element. The first closure part and the at least one second closure part can be placed against each other along a placement direction.

15 Claims, 10 Drawing Sheets

(56) References Cited

U.S. PATENT DOCUMENTS

| | | | | |
|---|---|---|---|---|
| 2012/0248793 | A1* | 10/2012 | Fiedler ..... | A44B 11/2592 70/330 |
| 2015/0135486 | A1 | 5/2015 | Fiedler et al. | |
| 2016/0183642 | A1 | 6/2016 | Fiedler | |
| 2016/0219988 | A1 | 8/2016 | Huang | |
| 2017/0015229 | A1 | 1/2017 | Fiedler | |
| 2019/0387845 | A1 | 12/2019 | Lee et al. | |
| 2020/0069002 | A1 | 3/2020 | Fiedler et al. | |
| 2020/0324938 | A1 | 10/2020 | Font de Rubinat Avila et al. | |

FOREIGN PATENT DOCUMENTS

| | | | |
|---|---|---|---|
| EP | 2271233 | B1 | 4/2012 |
| EP | 2166895 | B1 | 5/2012 |
| EP | 2218083 | B1 | 10/2012 |
| EP | 2040572 | B1 | 12/2012 |
| EP | 3116747 | B1 | 4/2018 |
| EP | 3019757 | B1 | 9/2019 |
| WO | 2009127196 | A2 | 10/2009 |
| WO | 2014090926 | A1 | 6/2014 |

* cited by examiner

CLOSURE DEVICE WITH CLOSURE PARTS WHICH CAN BE PLACED AGAINST EACH OTHER

CROSS-REFERENCE TO RELATED APPLICATIONS

This application is a divisional of U.S. patent application Ser. No. 17/277,345, filed Mar. 18, 2021, which is the United States national phase of International Application No. PCT/EP2019/074855 filed Sep. 17, 2019, and claims priority to German Patent Application No. 10 2018 123 026.5 filed Sep. 19, 2018, the disclosures of which are hereby incorporated by reference in their entirety.

BACKGROUND OF THE INVENTION

Field of the Invention

This disclosure relates to a closure device.

Description of Related Art

Such a closure device comprises a first closure part which includes a base body and at least one closure element rotatably arranged on the base body around an axis of rotation. The at least one closure element comprises a base body and at least one first locking portion arranged on the base body. At least one second closure part includes a base element and at least one second locking portion arranged on the base element. The first closure part and the at least one second closure part can be placed against each other along a placement direction such that in a closed position the at least one locking portion of the at least one closure element and the locking portion of the at least one second closure part are in engagement with each other and the closure parts thus are attached to each other. To release the first closure part and the at least one second closure part from each other, the at least one closure part can be rotated relative to the base body of the first closure part so as to bring the at least one first locking portion of the at least one closure element and the at least one second locking portion of the at least one second closure part out of engagement with each other.

In closures for fastening a belt for example for a child seat or a perambulator, on the one hand an easy handling in particular for closing the closure device with a firm, loadable hold in the closed position is desirable. Here, care should be taken in particular that in use on a child seat in a vehicle under particular circumstances, for example in the event of a crash, high load forces may act, which must not cause the locking device to open.

It is also desirable to allow such closure device to be operated in a simple way also for opening.

In a closure device known from WO 2014/090926 A1 a first closure part and a second closure part can be placed against each other and in a closed position are positively in engagement with each other via engaging protrusions. Magnetic means act between the closure parts so that on placement the closure parts are drawn into engagement with each other and the closure parts are held against each other in the closed position.

SUMMARY OF THE INVENTION

An object underlying the proposed solution is to provide a closure device which is to be closed easily and comfortably, but also is to be opened again, with a high loadability in particular for use on a child seat or perambulator or also on a helmet, in particular a sports helmet such as a ski helmet or a bicycle helmet.

This object is achieved by a closure device with features as described herein.

Accordingly, the closure device includes an actuating element adjustably arranged on the base body, which is operatively connected to the at least one closure element in such a way that by adjusting the actuating element relative to the base body, the at least one closure element is rotatable relative to the base body.

Thus, the closure element on the base body of the first closure part can be actuated via an actuating element. The actuating element can be shifted or rotated with respect to the base body by a user in order to transmit an adjusting force to the closure element and to adjust the same relative to the base body in particular for opening the closure device so that with its first locking portion the closure element gets out of engagement with the second locking portion of the second closure part, and the first closure part and the second closure part thus can be released from each other.

The closure device in particular can include a plurality of closure elements rotatably arranged on the base body, against each of which a second (identically constructed) closure part can be placed. Such a configuration of the closure device may be advantageous in particular for use for example on a belt system for example for a child seat in a vehicle in order to thereby create a multipoint attachment. On each second closure part a belt can be arranged so that by attaching the second closure parts to the first closure part a plurality of belts can be fixed relative to the first closure part. There is obtained an easy handling in particular for closing the closure device.

When a plurality of closure elements are provided on the base body for attaching a plurality of second closure parts to the first closure part, the actuating element advantageously cooperates with all closure elements at the same time so that the closure elements can jointly be actuated by the actuating element in particular for opening the closure device. The actuating element can be operatively connected to all closure elements separately. It is, however, also conceivable and possible that the actuating element acts on one of the closure elements, which in turn is coupled to another closure element so that adjusting forces are introduced from the actuating element into a closure element and from the one closure element into the other closure elements.

The actuating element can be designed in different ways. For example, the actuating element can include a coupling portion via which the actuating element is positively or non-positively operatively connected to the at least one closure element. The actuating element can be designed for example as a rod element, as a wheel element, as a cable element, as a chain, as a force-deflecting slope or as a coulisse element. It is likewise conceivable to design the actuating element as a pushbutton which can be actuated by pressing, wherein the pressing movement can be converted into a rotary movement of the closure element via a suitable force deflection, for example a helical toothing.

In one embodiment, the actuating element is configured as a toothed rack or as a gear wheel. Correspondingly, the actuating element includes a toothing which cooperates with an associated counter-toothing of the closure element and thus drives the closure element. When the actuating element is configured as a toothed rack, for example, the actuating element preferably is linearly shiftable relative to the base body. When the actuating element is configured as a gear wheel (for example as a ring gear with an internal toothing), the actuating element is rotationally twistable relative to the base body.

Instead of a positive coupling with an associated closure element via a toothing, it is also conceivable to non-positively couple the actuating element with the closure element, for example by a frictional connection in which a friction surface of the actuating element cooperates with an associated friction surface of the closure element.

In one embodiment, the at least one locking portion is rigidly arranged on the base body of the at least one closure element. Likewise, the at least one second locking portion is rigidly arranged on the base element of the at least one second closure part. The at least one first locking portion and the at least one second locking portion hence are each configured rigid and substantially inelastic, and thus form rigid undercuts. On placement of the second closure part against an associated closure element of the first closure part, the locking portions are positively brought into engagement with each other so that a connection between the second closure part and the associated closure element of the first closure part is produced.

The closure device, however, can also employ another connecting technique, in which in particular one of the locking portions can be configured elastically resilient. In particular, the closure device can be configured in the form of a closure, as it is described in EP 2 040 572 B1, EP 2 166 895 B1, WO 2014/090926 A1, EP 3 019 757 A2, EP 3 116 747 B1 or EP 2 271 233 B1.

Such a closure device can include one or more closure elements on the first closure part so that one or more second closure parts can be placed against the first closure part.

In one embodiment, the at least one first locking portion protrudes from the base body of the closure element along the axis of rotation, and the at least one second locking portion likewise can protrude from the base element of the second closure part along the axis of rotation. When the second closure part is placed against an associated closure element of the first closure part, the locking portions come into engagement with each other and thus produce a connection between the second closure part and the first closure part so that in the closed position the second closure part is firmly and loadably held at the first closure part.

In one embodiment, the at least one first locking portion includes a first latching protrusion and the at least one second locking portion includes a second latching protrusion. The first latching protrusion and the second latching protrusion, which realize (in particular rigidly configured) undercuts, are positively in engagement with each other in the closed position and thus produce the connection between the second closure part and the closure element of the first closure part.

For example, run-up slopes can be formed on the latching protrusions so that on placement of the second closure part against the closure element of the first closure part, the latching protrusions can run up onto each other and thus be moved past each other until the latching protrusions come into engagement with each other in the closed position.

In one embodiment, the closure element includes two (or more) first locking portions arranged on the base body, which are arranged on different sides of the axis of rotation and for example face each other diametrically to the axis of rotation. The second closure part correspondingly includes two (or more) second locking portions which in the closed position are positively in engagement with the first locking portions of the closure element so that a connection between the second closure part and the closure element is produced via several pairs of locking portions.

On each first locking portion a first latching protrusion can be arranged, and on each second locking portion correspondingly a second latching protrusion. One of the first latching protrusions preferably points radially to the inside, whereas the other one of the first latching protrusions points radially to the outside, which allows the second latching protrusions of the second closure part to be brought into engagement with the first latching protrusions on the closure element in a common engagement direction transversely to the axis of rotation, in order to positively connect the second closure part to the closure element in the closed position.

For opening the closure device, the closure element preferably is rotatable relative to the second closure part by an angle greater than 90°, for example by up to 180° or even more than 180°. The first locking portions of the closure element and the second locking portions of the second closure part are shaped and arranged correspondingly, so that when the closure element is rotated relative to the second closure part, the locking portions do not impede a twisting movement between the closure element and the second closure part.

For example, the latching protrusions of the first locking portions of the closure element can be arranged on different radii (with respect to the axis of rotation) so that a positive connection between the first locking portions and the second locking portions is produced at different radial positions.

In one embodiment, the at least one second closure part includes a blocking element with a blocking portion, which serves to secure the connection of the second closure part to the associated closure element in the closed position. Correspondingly, in the closed position of the closure device the blocking portion is arranged on a side of the at least one first locking portion of the closure element facing away from the at least one second locking portion and thus blocks the engagement between the first locking portion and the associated second locking portion. The first locking portion and the second locking portion thus cannot come out of engagement with each other due to a transverse movement transversely to the axis of rotation, but are positively held in engagement with each other via the blocking portion.

In the closed position, the blocking portion in particular can be arranged radially inside the at least one locking portion. On the one hand, this provides for a reliable blockage, because forces acting transversely to the axis of rotation between the second closure part and the closure element act on the blocking portion with an unfavorable lever arm and thus cannot lead to an (unwanted) displacement of the blocking portion. In addition, the blocking portion comes to lie outside such a space, which is swept over by the locking portions on twisting of the closure element so that the blocking element with its blocking portion does not impede a rotary movement of the closure element, in particular for opening the closure device.

The blocking element, in one embodiment, is displaceable relative to the base element of at least one second closure part. For example, the blocking element can be elastically pretensioned relative to the base element along the axis of rotation, for example via a suitable spring element or by action of a magnetic force between the blocking element and the base element, which pretensions the blocking element in the direction of a blocking position for blocking the engagement between the locking portions.

The blocking element can be received in a receiving space of the second closure part for example with a head portion and can be displaceable in the receiving space. With its blocking portion the blocking element protrudes into the area of the locking portions so that via the blocking portion the positive connection between the locking portions can be secured when the closure device is in its closed position.

In one embodiment, the at least one closure element has a first side and a second side. On the first side and on the second side at least one first locking portion each is arranged, wherein one second closure part each can be placed against the first side and against the second side. Thus, two second closure parts can be placed against the closure element on different, preferably mutually opposite sides so that the closure element can be connected to a plurality of second closure parts. By rotating the closure element relative to the base body of the first closure part, the second closure parts can be released from the closure element at the same time so that a constructionally simple, easy-to-use closure device is obtained.

The second closure part to be placed against the first side and the second closure part to be placed against the second side here can be identical in construction so that closure parts of the same type can be placed against the different sides of the closure element.

The closure device can be of purely mechanical design and provide for a placement of the at least one second closure part against an associated closure element of the first closure part. In an advantageous embodiment, the closure device however is configured as a magneto-mechanical closure device in which the placement of the at least one second closure part against the first closure part is supported in a magnetic way.

For this purpose, the at least one closure element of the first closure part includes at least one first magnetic element and the at least one second closure part includes at least one second magnetic element, wherein the at least one first magnetic element and the at least one second magnetic element are configured to cooperate in a magnetically attracting manner when the first closure part and the at least one second closure part are placed against each other, so that the placement is supported in a magnetic way. Thus, the second closure part is magnetically drawn into engagement with the associated closure element and thus gets in connection with the closure element.

When the closure element is twisted for opening the closure device, the at least one first magnetic element of the closure element and the at least one second magnetic element of the second closure part can be displaced relative to each other in such a way that the force of magnetic attraction is attenuated or even converted into a repulsion. For example, the closure element and the second closure part each can include two magnetic elements, formed by permanent magnets, which are reversed in polarity with respect to each other when the closure element is rotated to open the closure device, so that a force of magnetic attraction is reversed into a magnetic repulsion. In this way, the opening of the closure device can be supported in a magnetic way.

The first closure part, in one embodiment, includes resetting means for resetting the actuating element back into a starting position associated with the closed position. Such resetting means for example can be formed by a spring which has a pretensioning effect between the base body and the actuating element. However, such resetting means for example can also act magnetically.

The object also is achieved by a closure device comprising a first closure part which includes a closure element with a base body and at least one first locking portion arranged on the base body, and a second closure part, which includes a base element and at least one second locking portion arranged on the base element. The first closure part and the second closure part can be placed against each other along a placement direction. In a closed position, the first closure part and the second closure part are placed against each other in such way that the at least one first locking portion of the closure element and the at least one second locking portion of the second closure part are in engagement with each other. To release the first closure part and the second closure part from each other, the at least one first locking portion of the closure element and the at least one second locking portion of the second closure part can be brought out of engagement with each other by rotating the closure element about an axis of rotation relative to the second closure part. It is provided that the second closure part includes a blocking element with a blocking portion which in the closed position is arranged radially inside the at least one first locking portion with respect to the axis of rotation and blocks the engagement of the at least one first locking portion and the at least one second locking portion with each other.

By providing the blocking element, the first locking portion and the second locking portion thus cannot come out of engagement with each other due to a transverse movement transversely to the axis of rotation, but are positively held in engagement with each other by means of the blocking portion.

Due to the fact that in the closed position the blocking portion is arranged radially inside the at least one locking portion, this on the one hand provides for a reliable blockage, because forces acting transversely to the axis of rotation between the second closure part and the closure element act on the blocking portion with an unfavorable lever arm and thus cannot lead to an (unwanted) displacement of the blocking portion. In addition, the blocking portion comes to lie outside such a space which is swept over by the locking portions on twisting of the closure element so that the blocking element with its blocking portion does not impede a rotary movement of the closure element, in particular for opening the closure device.

The blocking element, in one embodiment, is adjustable relative to the base element of at least one second closure part. For example, the blocking element can be elastically pretensioned relative to the base element along the axis of rotation, for example via a suitable spring element or by action of a magnetic force between the blocking element and the base element, which pretensions the blocking element in the direction of a blocking position for blocking the engagement between the locking portions.

The blocking element can be received in a receiving space of the second closure part for example with a head portion and can be displaceable in the receiving space. With its blocking portion, the blocking element protrudes into the area of the locking portions so that via the blocking portion the positive connection between the locking portions can be secured when the closure device is in its closed position.

In one embodiment, the closure element includes two (or more) first locking portions arranged on the base body, which are arranged on different sides of the axis of rotation and for example face each other diametrically to the axis of rotation. The second closure part correspondingly includes two (or more) second locking portions which in the closed position are positively in engagement with the first locking portions of the closure element so that a connection between the second closure part and the closure element is produced via several pairs of locking portions.

On each first locking portion a first latching protrusion can be arranged, and on each second locking portion correspondingly a second latching protrusion. One of the first latching protrusions preferably points radially to the inside, whereas the other one of the first latching protrusions points radially to the outside, which allows the second latching protrusions of the second closure part to be brought into engagement with the first latching protrusions on the closure element in a common engagement direction transversely to the axis of rotation, in order to positively lock the second closure part with the closure element in the closed position.

For opening the closure device, the closure element preferably is rotatable relative to the second closure part by an angle greater than 90°, for example by up to 180° or even more than 180°. The first locking portions of the closure element and the second locking portions of the second closure part are shaped and arranged correspondingly, so that when the closure element is rotated relative to the second closure part, the locking portions do not impede a twisting movement between the closure element and the second closure part.

For example, the latching protrusions of the first locking portions of the closure element can be arranged on different radii (with respect to the axis of rotation) so that a positive connection between the first locking portions and the second locking portions is produced at different radial positions.

The closure element, in one embodiment, can form the first closure part so that the closure device has a two-part design and to open the closure device, the closure element as a whole is rotatable relative to the second closure part. It is, however, also conceivable and possible to provide the first closure part with a three-part design, comprising a base body on which the closure element is rotatably arranged about the axis of rotation. On the base body, for example, a belt attachment can be mounted for fastening a belt, wherein with a stationary base body the closure element is rotatable relative to the second closure part in order to open the closure device.

Advantageously, the closure device is configured as a magneto-mechanical closure device. For this purpose, the closure element of the first closure part includes at least one first magnetic element and the second closure part includes at least one second magnetic element, wherein the at least one first magnetic element and the at least one second magnetic element are configured to cooperate in a magnetically attracting manner when the first closure part and the second closure part are placed against each other, so that the placement is supported in a magnetic way. Thus, the second closure part is magnetically drawn into engagement with the associated closure element and thus gets into connection with the closure element.

When the closure element is twisted for opening the closure device, the at least one first magnetic element of the closure element and the at least one second magnetic element of the second closure part can be displaced relative to each other in such a way that the force of magnetic attraction is attenuated or even reversed into a repulsion. For example, the closure element and the second closure part each can include two magnetic elements, formed by permanent magnets, which are reversed in polarity with respect to each other when the closure element is twisted to open the closure device, so that a force of magnetic attraction is reversed into a magnetic repulsion. In this way, however, opening of the closure device can be supported in a magnetic way.

The object also is achieved by a closure device comprising a first closure part which includes a closure element with a base body and at least one first locking portion arranged on the base body, and a second closure part which includes a base element and at least one second locking portion arranged on the base element. The first closure part and the second closure part can be placed against each other along a placement direction. In a closed position, the first closure part and the second closure part are placed against each other in such way that the at least one first locking portion of the closure element and the at least one second locking portion of the second closure part are in engagement with each other. To release the first closure part and the second closure part from each other, the at least one first locking portion of the closure element and the at least one second locking portion of the second closure part can be brought out of engagement with each other by rotating the closure element about an axis of rotation relative to the second closure part. It is provided that the closure element has a first side and a second side, wherein on the first side and on the second side at least one first locking portion each is arranged, wherein one second closure part each can be placed against the first side and against the second side.

Thus, two second closure parts can be placed against the closure element on different, preferably mutually opposite sides so that the closure element can be connected to a plurality of second closure parts. By rotating the closure element relative to the base body of the first closure part, the second closure parts can be released from the closure element at the same time so that a constructionally simple, easy-to-use closure device is obtained.

The second closure part to be placed against the first side and the second closure part to be placed against the second side here can be identical in construction so that closure parts of the same type can be placed against the different sides of the closure element.

A closure device of the type described above can be used as a closure for connecting two or more parts to each other. In particular, a closure device as described above can be used as a belt buckle for example for a seat, in particular for a child seat in a vehicle or for a perambulator in order to connect one or more belt portions to a belt buckle.

A closure device as described above can also be used for example as a closure for a helmet, in particular for a sports helmet, for example a ski helmet or a bicycle helmet.

BRIEF DESCRIPTION OF THE DRAWINGS

The idea underlying the proposed solution will be explained in detail below with reference to the exemplary embodiments illustrated in the Figures.

DESCRIPTION OF THE INVENTION

Figure 2:
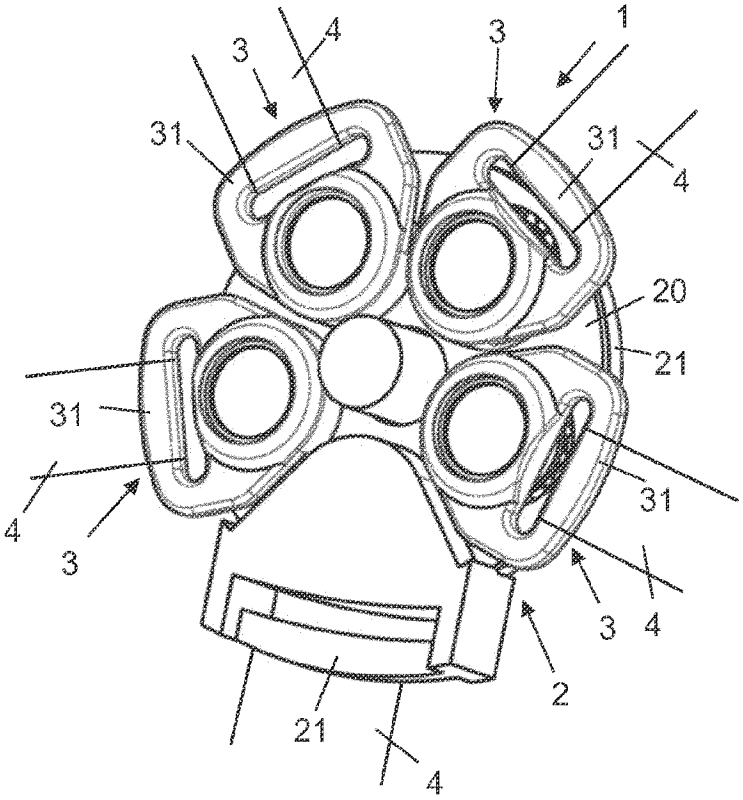
FIG. 2 shows a view of the closure device, in a closed position.
Figure 1:
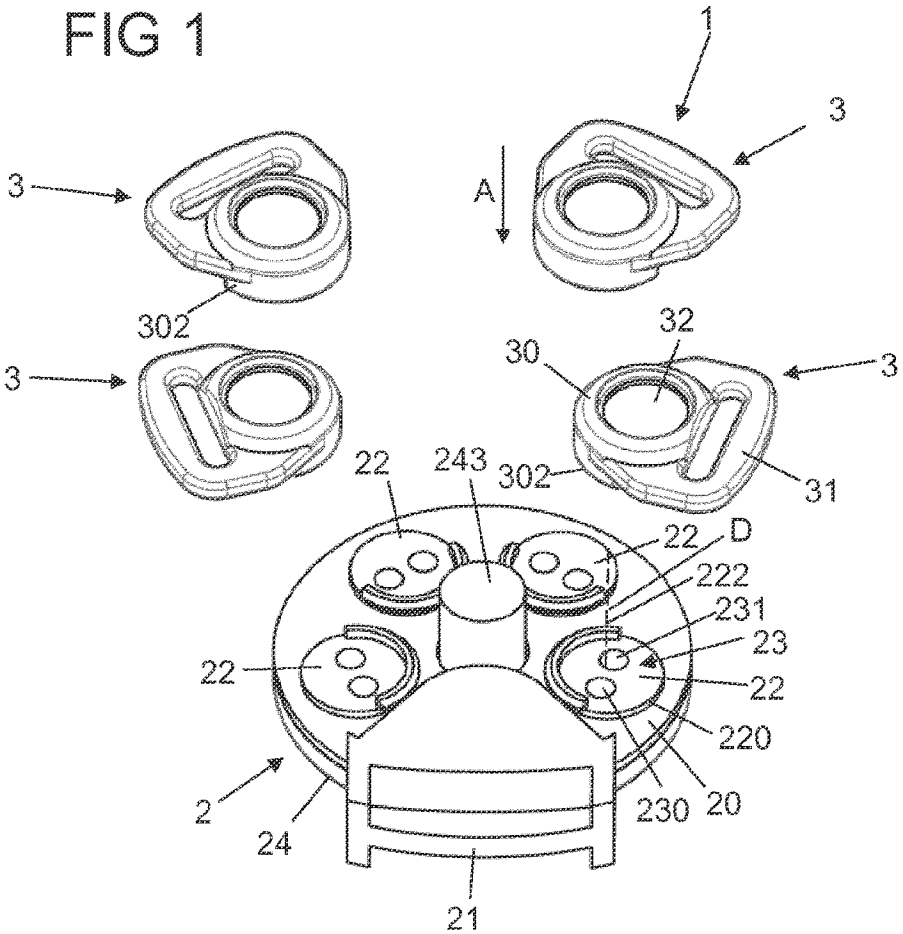
FIG. 1 shows a view of an exemplary embodiment of a closure device which includes a first closure part with a plurality of closure elements rotatably arranged on a base body and a plurality of second closure parts, in an open position.
Figure 3:
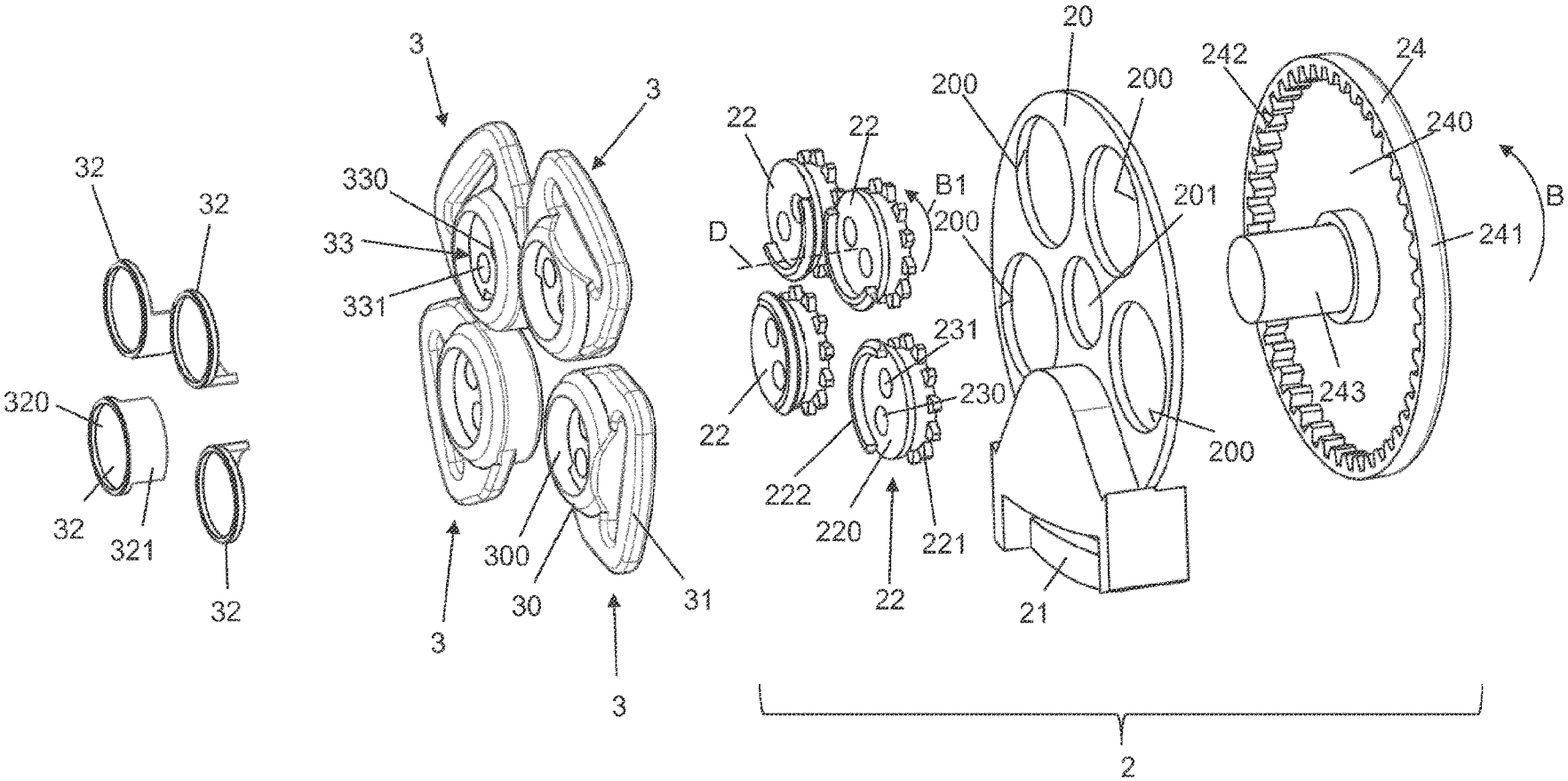
FIG. 3 shows an exploded view of the closure device.

FIGS. 1 to 3 show an exemplary embodiment of a closure device 1 which includes a first closure part 2 with a plurality of closure elements 22 arranged on a base body 20 and a plurality of second closure parts 3 to be placed against the closure elements 22 of the first closure part 2 along a placement direction A. In a closed position shown in FIG. 2, the second closure parts 3 are connected to the closure elements 22 and thereby held on the first closure part 2.

On the base body 20 of the first closure part 2 a belt attachment 21 is arranged, via which a belt 4 (schematically indicated in FIG. 2) can be attached to the first closure part 2. In addition, each second closure part 3 includes a belt attachment 31 via which a belt 4 can respectively be attached to each second closure part 3. In the closed position of the closure device 1, a multipoint attachment thereby is created, by means of which a plurality of belts 4 are connected to each other.

Such a closure device for example can be used as a belt buckle in a child seat in a vehicle or in a perambulator.

The closure elements 22 of the first closure part 2 each are rotatably arranged on the base body 20 of the first closure part 2 about an axis of rotation D. Each closure element 2 includes a base body 220 and a locking portion 222 molded thereto and protruding from the base body 220 along the axis of rotation D, which serves to positively come into engagement with an associated locking portion 302 of a second closure part 3.

In the closed position, the locking portion 222 of each closure element 22 is positively in engagement with a radially inwardly pointing latching protrusion on the locking portion 302 of an associated second closure part 3 via a radially outwardly pointing latching protrusion molded thereto. As is shown in FIG. 2, the closure parts 3 in this way each are positively connected to a closure element 22 and thereby held on the first closure part 2.

The locking portion 302 in the exemplary embodiment of FIGS. 1 to 3 is functionally identical with the locking portion 302 of the exemplary embodiment of FIGS. 4 to 10 described below, so that in this respect reference is made to the following explanations, in particular to the explanations of FIGS. 8A to 8C.

The closure elements 22 each include a magnetic device 23 with two magnetic elements 230, 231 preferably formed by permanent magnets. As can be taken from the exploded views of FIG. 3, each second closure part 3 also includes a magnetic device 33 with two magnetic elements 330, 331 preferably formed by permanent magnets, which on placement of the second closure parts 3 against the first closure part 2 cooperate with the magnetic elements 230, 231 of the closure elements 22 and thus support the placement of the second closure parts 3 by a force of magnetic attraction.

Due to the magnetic effect, in particular the locking portions 222, 302 of the closure elements 22 and of the second closure parts 3 are positively drawn into engagement with each other so that in the closed position the second closure parts 3 are securely and reliably locked into place at the first closure part 2 by means of the closure elements 22.

As can be taken from the exploded views of FIG. 3, the base body 20 includes bearing openings 200, in each of which a closure element 22 is rotatably mounted about an associated axis of rotation D. The closure elements 22 here each include a circumferential, radially outwardly protruding toothing 221 on their base body 220, which is in engagement with an internal toothing 242 on a collar 241 of an actuating element 24 configured as a ring gear. Via a shaft 243 protruding from a body 240 of the actuating element 24, the actuating element 24 is rotatably mounted on a central bearing opening 201 on the base body 20 of the first closure part 2 so that the actuating element 24 can be rotated relative to the base body 20 of the first closure part 2 along an actuating direction B.

Via resetting means, for example a spring acting between an associated closure element 22 and the base body 20, the closure elements 22 can be resettable into their starting position associated to the closed position. Via resetting means, the actuating element 24 additionally or alternatively can be reset in the direction of its starting position associated to the closed position.

By means of the actuating element 24, the closure elements 22 can be jointly actuated to open the closure device 1. By rotating the actuating element 24 along the actuating direction B, the closure elements 22 each are rotated relative to the base body 20 about their axis of rotation D along an actuating direction B1, due to the meshing engagement of the toothing 242 of the actuating element 24 with the toothings 221 of the closure elements 22, so that each locking portion 222 on the base body 220 is rotated out of engagement with the associated locking portion 302 of the respective second closure part 3, and the second closure parts 3 thus can be removed from the first closure part 2 against the placement direction A.

By rotating the closure elements 22 (by approximately 180°), the magnetic elements 230, 231, 330, 331 also are reversed in polarity relative to each other, so that the force of magnetic attraction is reversed into a force of magnetic repulsion so that with twisted closure elements 22 the second closure parts 3 are repelled from the first closure part 2 against the placement direction A and thus are automatically separated from the first closure part 2.

The magnetic elements 230, 231 of a respective closure element 22 with unlike poles (N, S) point towards an associated second closure part 3. Likewise, the magnetic elements 330, 331 of the second closure part 3 with unlike poles (S, N) point towards the associated closure element 22, wherein on placement the magnetic elements 230, 231, 330, 331 are arranged relative to each other such that the magnetic elements 230, 231, 330, 331 attract each other. By twisting the respective closure element 22 to open the closure device 1, the magnetic elements 230, 231, 330, 331 however are moved towards each other so that the magnetic elements 230, 231 on the part of the closure element 22 now with like poles come to face the magnetic elements 330, 331 on the part of the associated second closure part 3, and thus a magnetic repulsion exists between the second closure part 3 and the closure element 22.

By means of the closure device 1 a plurality of second closure parts 3 can be placed against a first closure part 2 in a simple, comfortable way in order to create a multipoint attachment. The closure device 1 is loadable and reliably holds the second closure parts 3 on the first closure part 2 also under load.

Each second closure part 3 includes a blocking element 32 received in a receiving space 300 of the base element 30 of the second closure part 3, which blocking element includes a head portion 320 resting in the receiving space 300 and a blocking portion 321 axially protruding from the head portion 320. The blocking element 32 serves for blocking the engagement of the locking portions 222, 302 with each other in the closed position, as this will yet be explained below with reference to the further exemplary embodiments.

Figure 5:
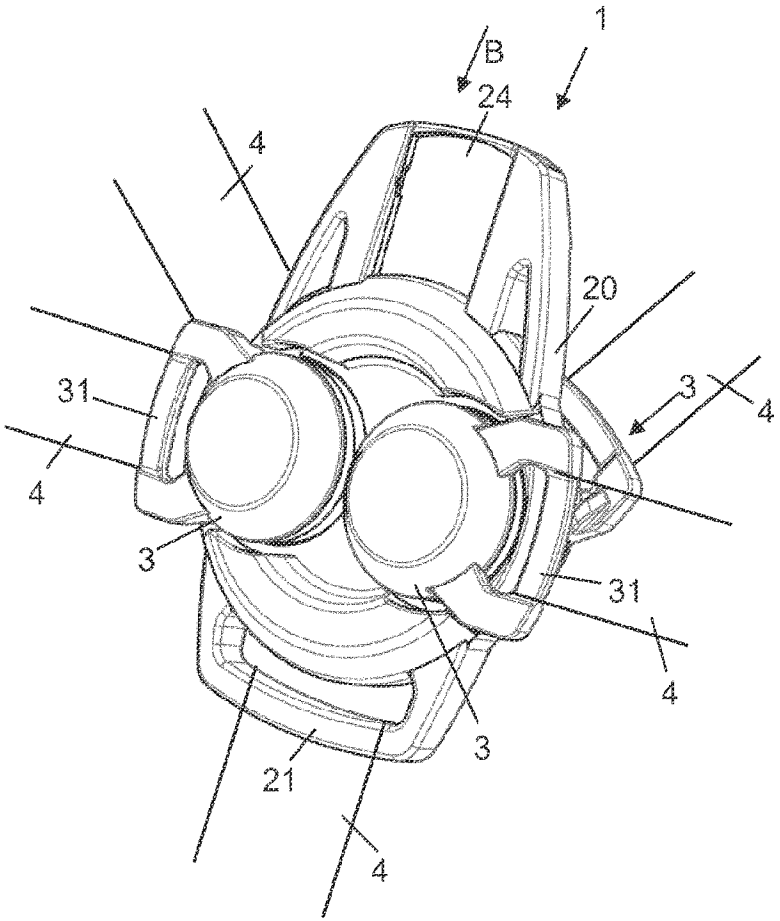
FIG. 5 shows a view of the closure device as shown in FIG. 4, in a closed position.
Figure 4:
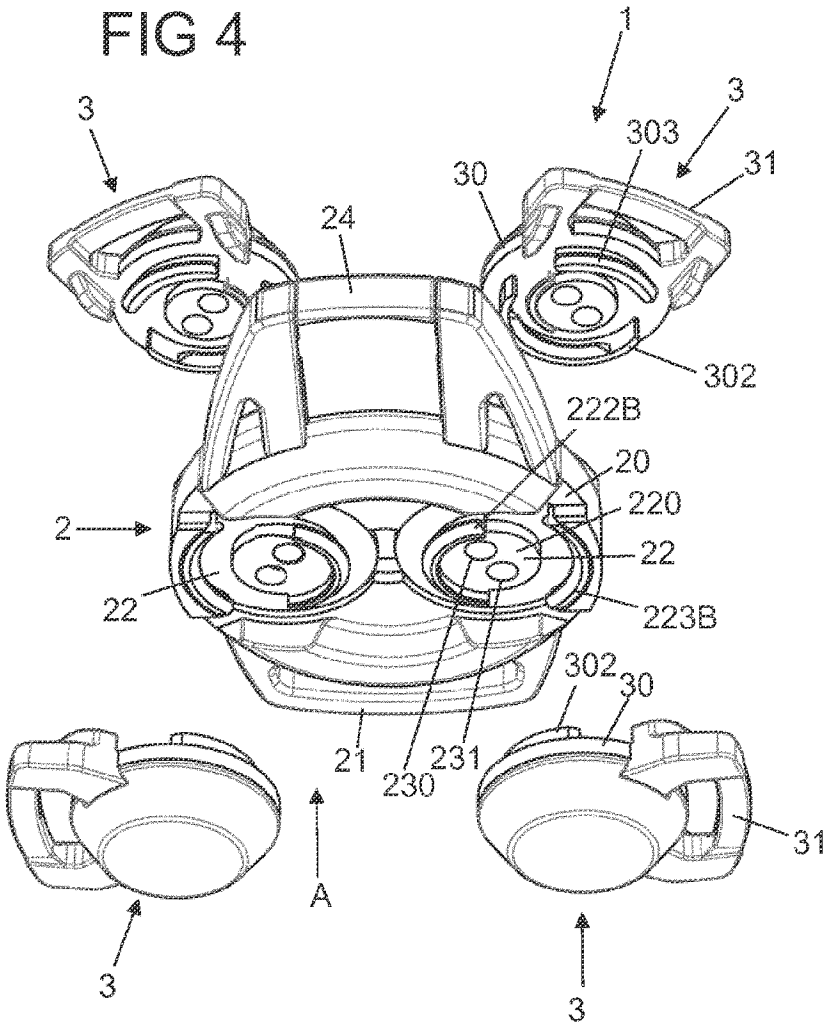
FIG. 4 shows a view of another exemplary embodiment of closure device, in an open position.
Figure 6:
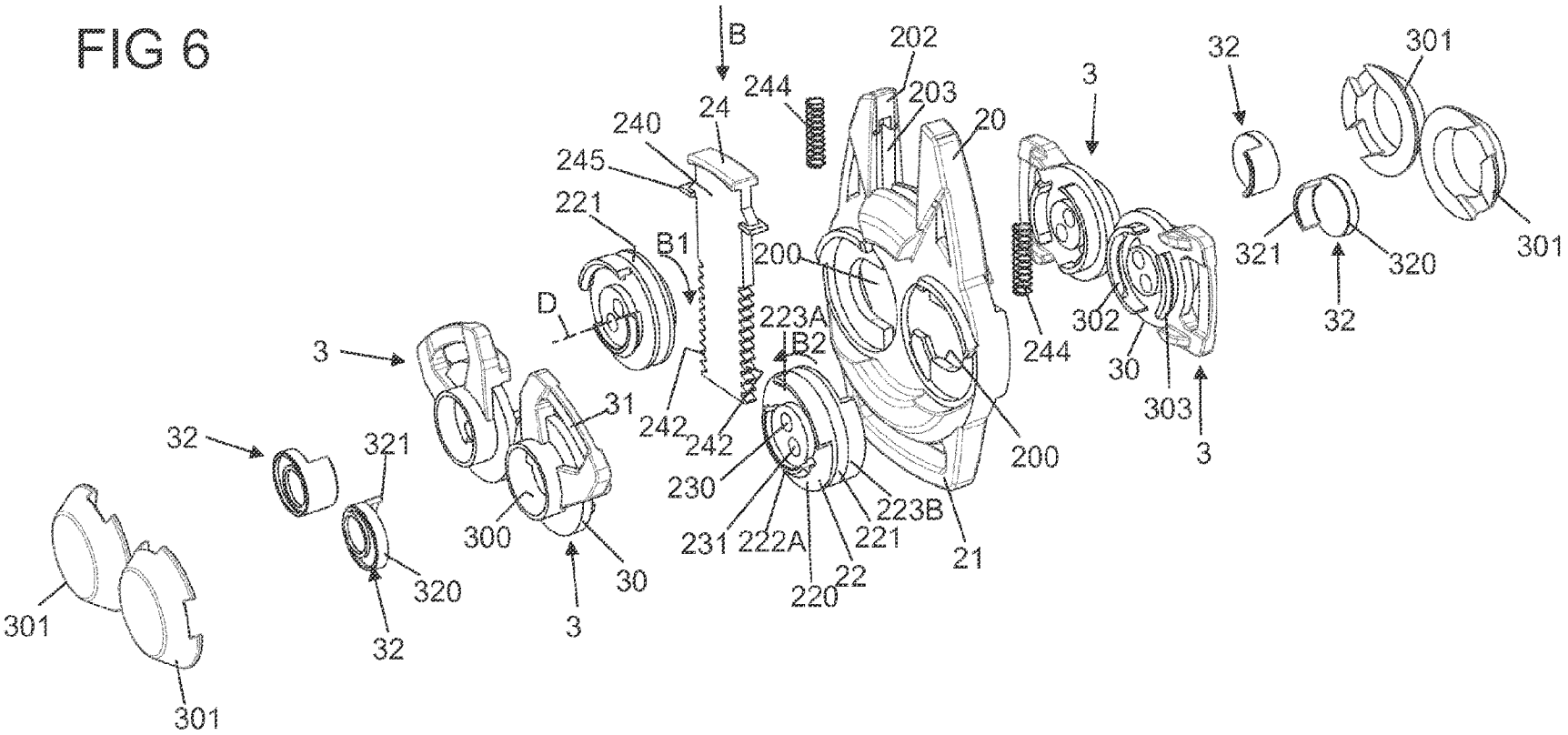
FIG. 6 shows an exploded view of the closure device as shown in FIGS. 4 and 5.

In another exemplary embodiment illustrated in FIGS. 4 to 6, second closure parts 3 are to be placed against closure elements 22 of a first closure part 2, wherein in this exemplary embodiment each closure element 22 includes two locking portions 222A, 223A, 222B, 223B on different sides, and thus, the second closure elements 3 can be placed against a closure element 22 from different sides. In the closed position shown in FIG. 5, two second closure parts 3 are held on each side of the first closure part 2 so that again a multipoint attachment is created.

A belt 4 here is arranged on a belt attachment 21 on a base body 20 of the first closure part 2. Moreover, each second closure part 3 includes a belt attachment 31 on a base element 30, via which a belt 4 is fixed to the respective second closure part 3, as this is schematically indicated in FIG. 5.

In the exemplary embodiment shown in FIGS. 4 to 6, two locking portions 222A, 223A, 222B, 223B facing each other diametrically to an axis of rotation D (about which the closure element 22 is rotatably mounted on the base body 20 of the first closure part 2) are arranged on each side of a closure element 22, which can each be positively brought into engagement with two locking portions 302, 303 on associated second closure parts 3.

As can be taken from the exploded views of FIG. 6, each second closure part 3 includes a blocking element 32 which with a head portion 320 is received in a receiving space 300 of the base element 30 of the respectively associated second closure part 3 and with a blocking portion 321 protrudes into the area of the locking portions 302, 303 on the base element 30 of the second closure part 3. The receiving space 300 is closed towards the outside by a lid element 301.

The mode of operation of the closure device 1 for placing, holding and releasing a second closure element 3 on an associated closure element 22 of the first closure part 2 will be explained below with reference to FIGS. 7 and 8A to 8C. FIGS. 7 and 8A, 8B, 8C show a second closure element 3 on an associated closure element 22, which is rotatably mounted on the base body 20 of the first closure part 2 about an axis of rotation D.

Figure 8A:
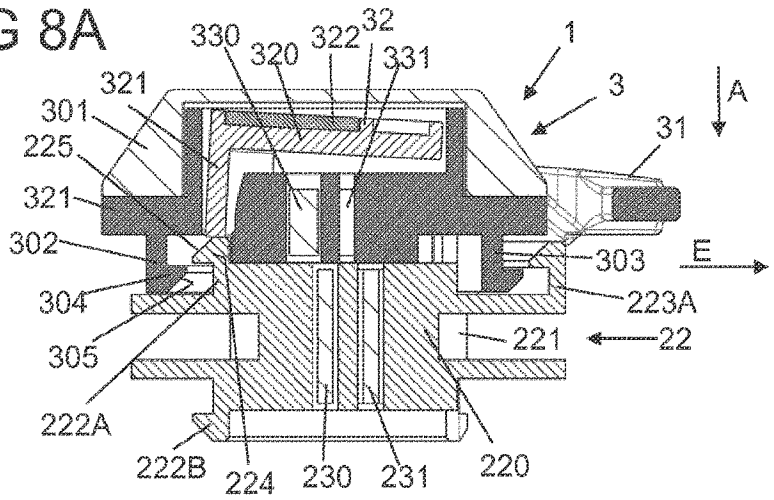
FIG. 8A shows a sectional view along line A-A of FIG. 7 on placement of two closure parts of the closure device against each other.
Figure 8C:
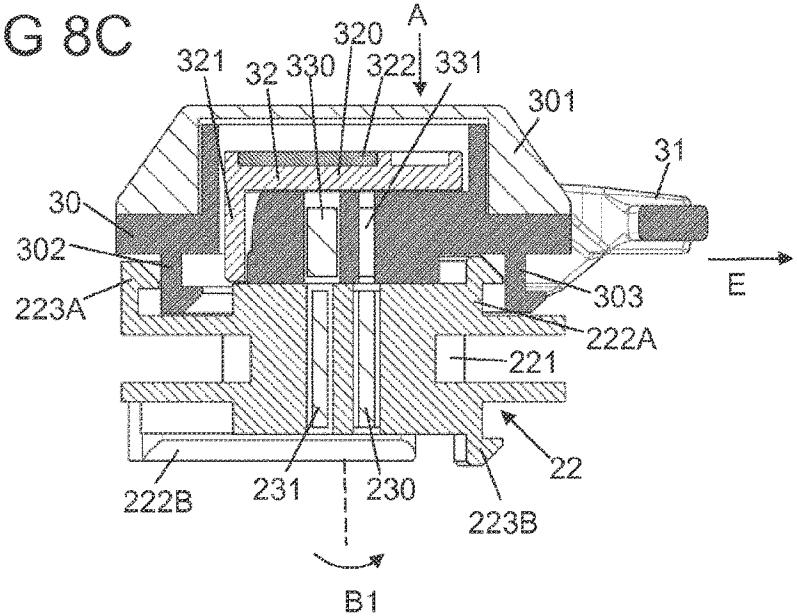
FIG. 8C shows a sectional view of the closure device along line A-A of FIG. 7 on opening of the closure device.
Figure 7:
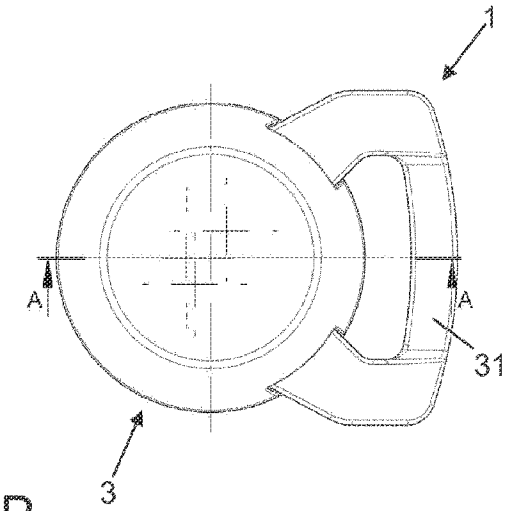
FIG. 7 shows a top view of a second closure part arranged on a closure element of a first closure part.
Figure 8B:
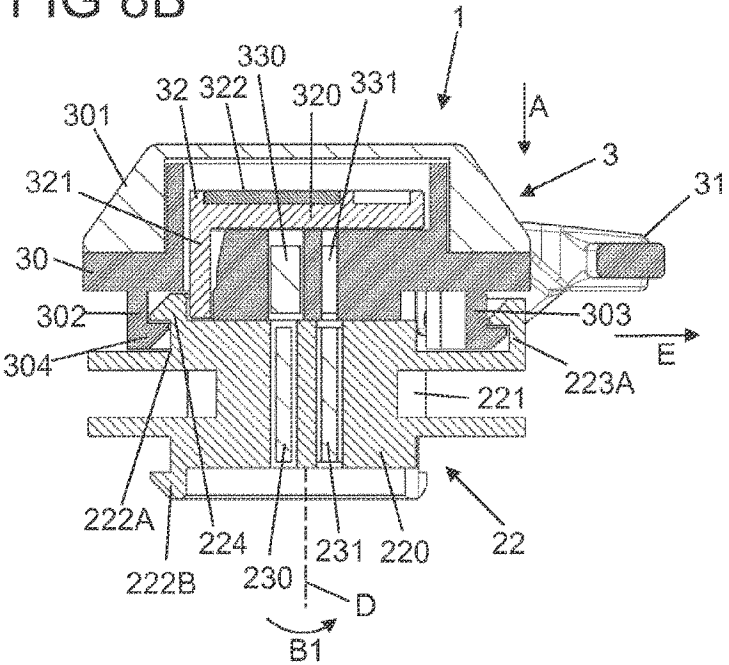
FIG. 8B shows a sectional view of the closure device along line A-A of FIG. 7, in a closed position.
Figure 10:
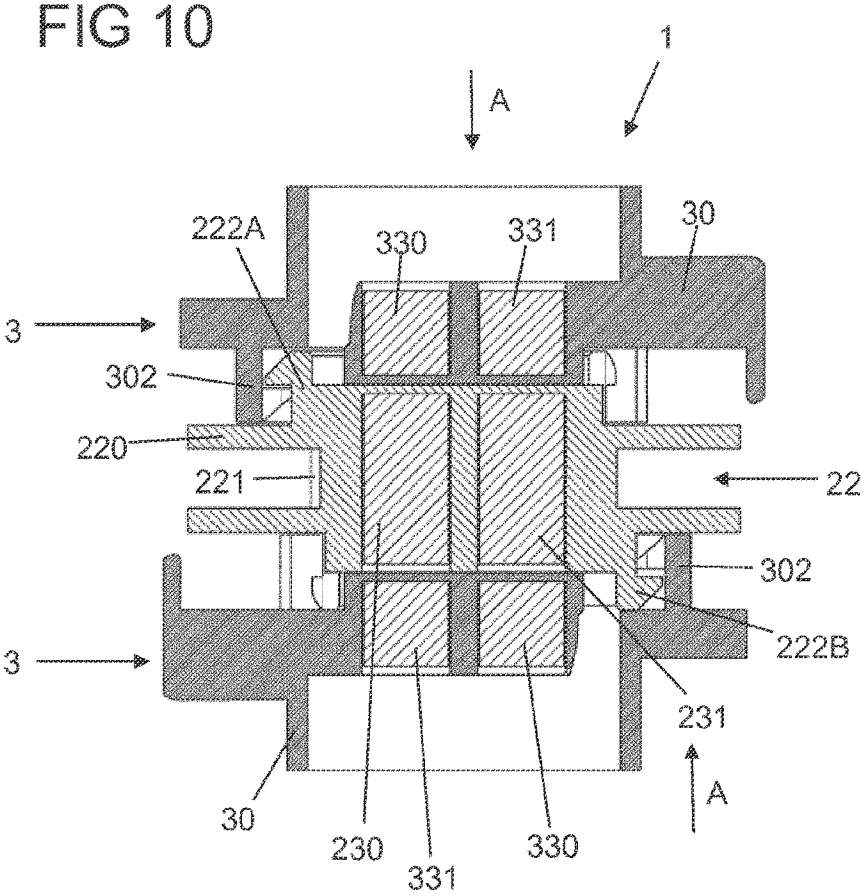
FIG. 10 shows a sectional view along line B-B of FIG. 9.
Figure 9:
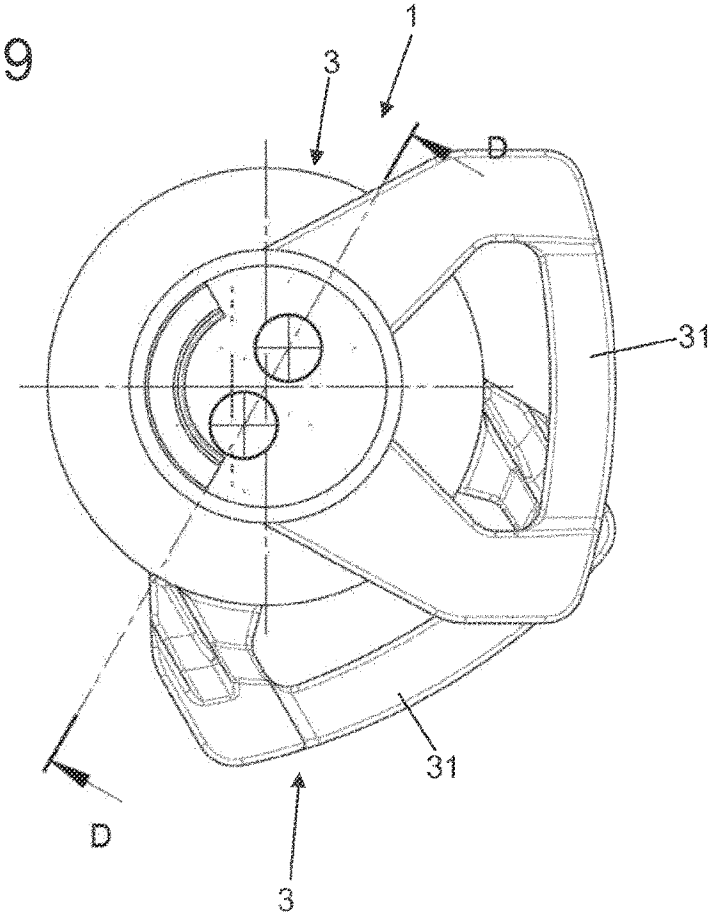
FIG. 9 shows a top view of an arrangement in which two second closure parts are placed against a closure element of a first closure part.
Figure 12A:
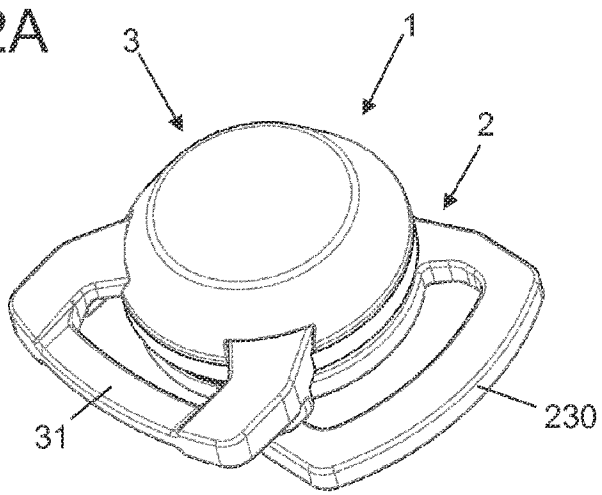
FIG. 12A shows a view of the closure device on opening.
Figure 12B:
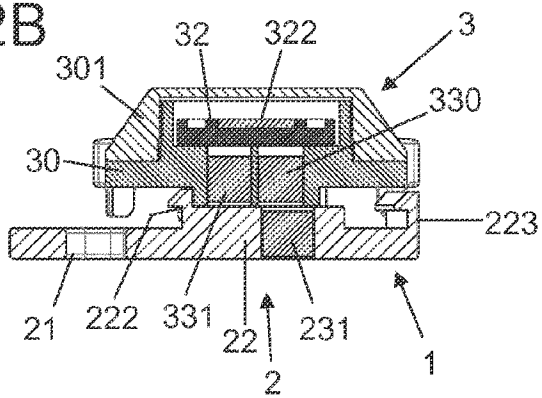
FIG. 12B shows a sectional view through the closure device as shown in FIG. 12A.
Figure 11A:
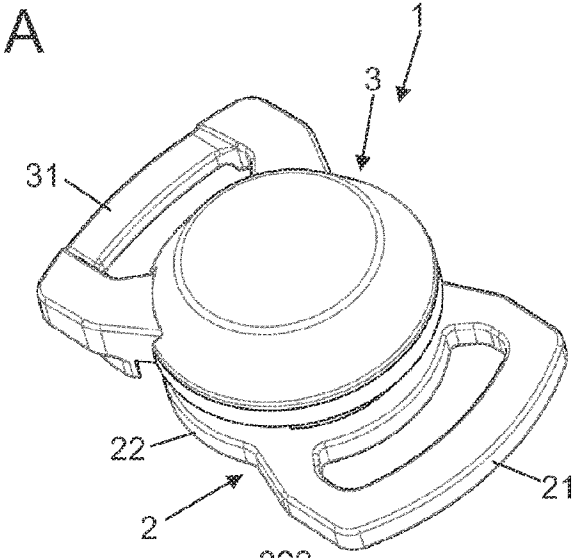
FIG. 11A shows a view of an exemplary embodiment of a closure device, in a closed position.
Figure 11B:
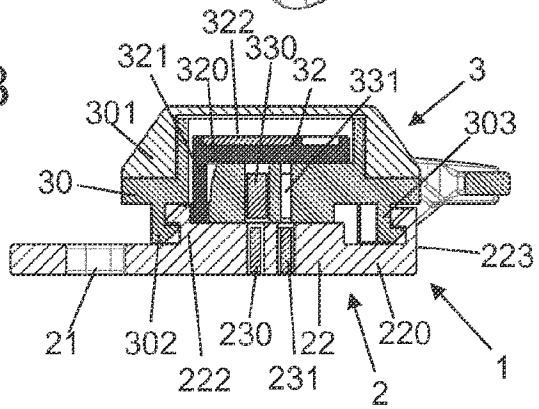
FIG. 11B shows a sectional view longitudinally through the closure device as shown in FIG. 11A.
Figure 13:
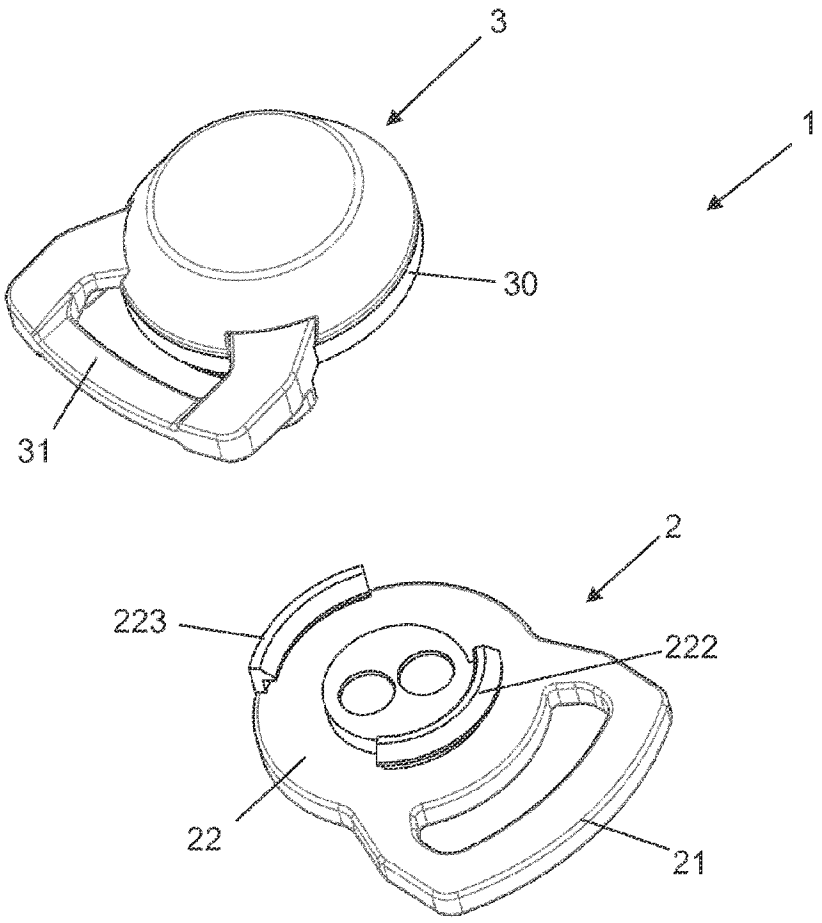
FIG. 13 shows a view of the closure device with closure parts separated from each other.

On the closure element 22 two magnetic elements 230, 231 are arranged, which on placement of the second closure part 3 against the closure element 22 cooperate with magnetic elements 330, 331 on the base element 30 of the second closure part 3 in a magnetically attracting way (FIGS. 8A to 8C show the magnetic elements 230, 231, 330, 331 in a sectional representation; as can be taken from a synopsis of FIG. 9 with FIG. 10, the magnetic elements 230, 231, 330, 331 each have a cylindrical shape and, on placement of a second closure part 3 against an associated closure element 22, face each other with unlike poles in such a way that a force of magnetic attraction exists between the second closure part 3 and the closure element 22).

On placement of the second closure part 3 against the closure element 22, the locking portions 302, 303 with latching protrusions 304 molded thereto get in contact with the locking portions 222A, 223A on the associated side of the closure element 33 and with run-up slopes 305 run up onto the run-up slope 225 on the locking portions 222A, 223A of the closure element 22 so that the locking portions 302, 303 are moved past the locking portions 222A, 223A of the closure element 22 with an offset transversely to the direction of rotation D (against an engagement direction E). The blocking portion 321 of the blocking element 32 on the second closure part 3 thereby gets in contact with the locking portion 222A of the closure element 22 in the placement direction A and is displaced with respect to the base element 30 by the locking portion 222A, against a force of magnetic attraction between the blocking element 32 and the base element 30 due to an interaction between a magnetic element 322 on the head portion 320 of the blocking element 32 (formed for example by a magnetic armature made of a ferromagnetic material) and the magnetic elements 330, 331 on the base element 30.

Due to the magnetic action between the magnetic elements 230, 231, 330, 331 on the closure element 22 on the one hand and the base element 30 of the second closure part 3 on the other hand, the locking portions 222A, 223A, 302, 303 then are drawn into engagement with each other in the engagement direction E so that the second closure part 3 reaches the closed position shown in FIG. 8B, and the second closure part 3 thus is positively held on the closure element 22, as is shown in FIG. 8B.

In the closed position, the blocking portion 321 of the blocking element 32 comes to lie on a radially inner side of the locking portion 222A of the closure element 22 facing away from the locking portion 302, as is shown in FIG. 8B. The blocking portion 321 thus secures the engagement between the locking portions 222A, 302 and thereby also the engagement between the locking portions 223A, 303 on the other side. In particular, the second closure part 3 cannot be offset from the adjusting element 22 against the engagement direction E, and the positive connection between the locking portions 222A, 223A, 302, 303 can be eliminated.

When the closure device 1 is to be opened and the second closure part 3 is to be released from the closure element 22, the closure element 22 can be rotated by approximately 180° about the axis of rotation D along an actuating direction B1 so that, as shown in FIG. 8C, the locking portions 222A, 223A, 302, 303 get out of engagement with each other, and the positive connection between the second closure part 3 and the closure element 22 therefore is eliminated.

By twisting the closure element 22, the magnetic elements 230, 231, 330, 331 also are rotated relative to each other such that the magnetic elements 230, 231, 330, 331 now face each other in pairs with like poles, so that the magnetic elements 230, 231, 330, 331 magnetically repel each other and the release of the second closure part 3 from the closure element 22 therefore is magnetically supported.

As can be taken from FIGS. 9 and 10, a second closure part 3 respectively can be placed against each side of the closure element 22. The second closure parts 3 are identical in construction, and the positive connection is produced in the same way for each second closure part 3 and can also be released again in the same way.

In the exemplary embodiment shown in FIGS. 4 to 6, the first closure part 2 includes an actuating element 24 which is configured as a toothed rack and is shiftable relative to the base body 20 of the first closure part 2 along an actuating direction B. The actuating element 24 is received in a guide recess 202 of the base body 20 and is guided in the guide recess 202 along the actuating direction B. Supporting elements 245 extend into spring seats 203 on both sides of the guide recess 202 and act on spring elements 244 in the form of compression springs received in the spring seats 203, via which the actuating element 24 is pretensioned by spring force relative to the base body 20 in the direction of a starting position associated to the closed position, which is shown in FIG. 5, against the actuating direction B.

The actuating element 24 in the form of a toothed rack includes two toothings 242 on mutually opposite sides, which each are in coupling engagement with one of the closure elements 22. Each closure element 22 therefor includes a coupling portion 221 in the form of a circumferential toothing, via which the actuating element 24 meshes with the respective closure element 22 so that on actuation of the actuating element 24 in the actuating direction B, the closure elements 22 are jointly rotated relative to the base body 20 of the first closure part 2 along an actuating direction B1, B2. The closure elements 22 thereby are adjusted relative to the respectively associated second closure parts 3 so that the form fit between the closure elements 22 and the second closure parts 3 is eliminated and the second closure parts 3 thus can be removed from the first closure part 2 for opening the closure device 1.

Due to the fact that in the closed position the blocking portion 321 of the blocking element 32 comes to lie radially inside the associated blocking portion 222A of the closure element 22, an advantageous behavior is obtained with loaded closure parts 2, 3 such that the locking portions 222A, 302 are kept in engagement by the blocking portion 321 and even a clearance between the locking portions 222A, 302 cannot lead to an opening of the closure device 1 under the influence of loading forces.

Due to the fact that second closure parts 3 can be placed against different sides of a closure element 22, magnetic elements 230, 231 in the form of permanent magnets on the closure element 22 can also cooperate with the closure parts 3 on different sides in the same way. The connection of the second closure parts 3 to the closure element 22 on opposite sides thereof thus provides for a simple configuration to provide a multipoint attachment while reducing the number of components of the closure device 1, and in addition with an easy handling in particular for opening the closure device 1.

The arrangement as shown in FIGS. 7 and 8A to 8C also can realize a closure device 1 as such with (exactly) one closure element 22, against which two second closure parts 3 can be placed.

While the exemplary embodiments of FIGS. 1 to 10 realize closure devices 1 in which a plurality of second closure parts 3 are to be placed against a first closure part 2, it is also possible that in other exemplary embodiments of a closure device 1 merely one first closure part 2 and one second closure part 3 can be connected to each other.

In an exemplary embodiment shown in FIGS. 11A, 11B to 13, the closure device 1 includes a first closure part 2 and a second closure part 3 to be placed against the same, which in their mode of operation for placing the second closure part 3 against the first closure part 2 and for releasing the closure parts 2, 3 from each other are identical with the exemplary embodiment of FIGS. 7 and 8A to 8C so that in particular with regard to the mode of operation of the locking portions 222, 223, 302, 303 and of the blocking element 32 of the second closure part 3 reference will fully be made to the preceding explanations.

In the exemplary embodiment shown in FIGS. 11A, 11B to 13, the closure element 22 of the first closure part 2 is formed integrally with a belt attachment 21. The closure parts 2, 3 can be rotated relative to each other for opening, as this is illustrated in the transition from FIGS. 11A, 11B to FIGS. 12A, 12B. Thus, there is created a two-part closure device 1 with a first closure part 2 and a second closure part 3.

Figure 15A:
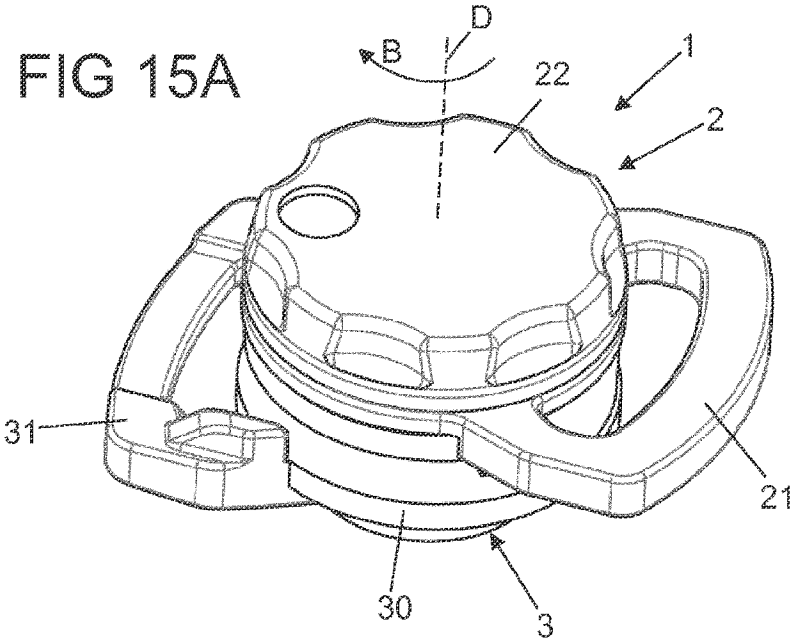
FIG. 15A shows a view of the closure device on opening.
Figure 15B:
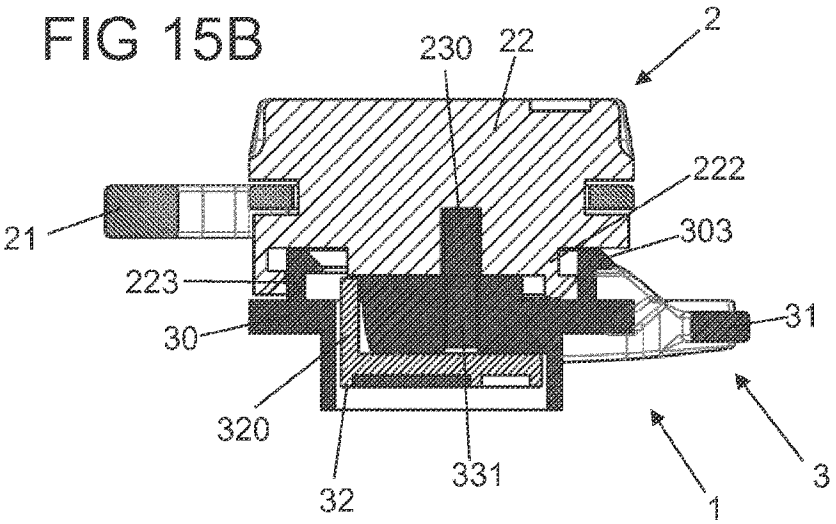
FIG. 15B shows a sectional view through the closure device as shown in FIG. 15A.
Figure 14A:
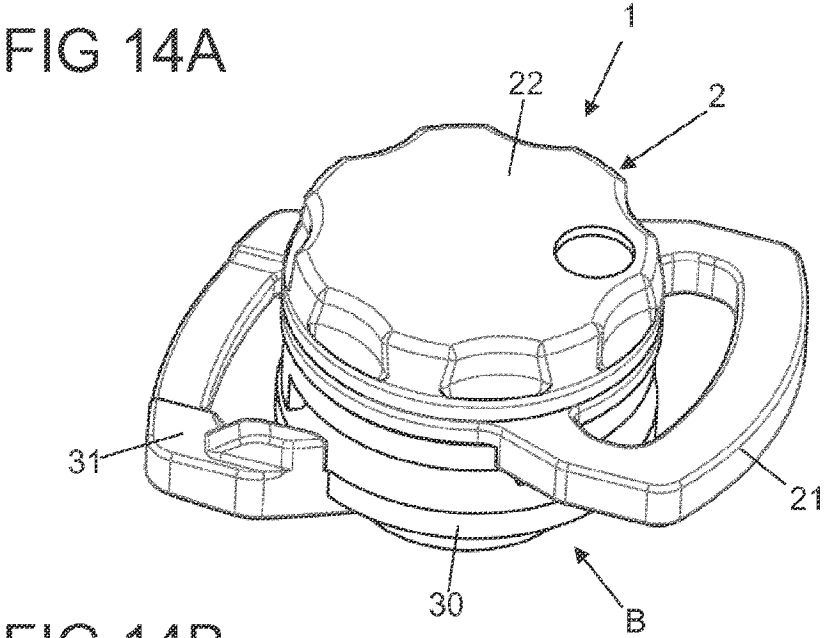
FIG. 14A shows a view of a closure device, in a closed position.
Figure 14B:
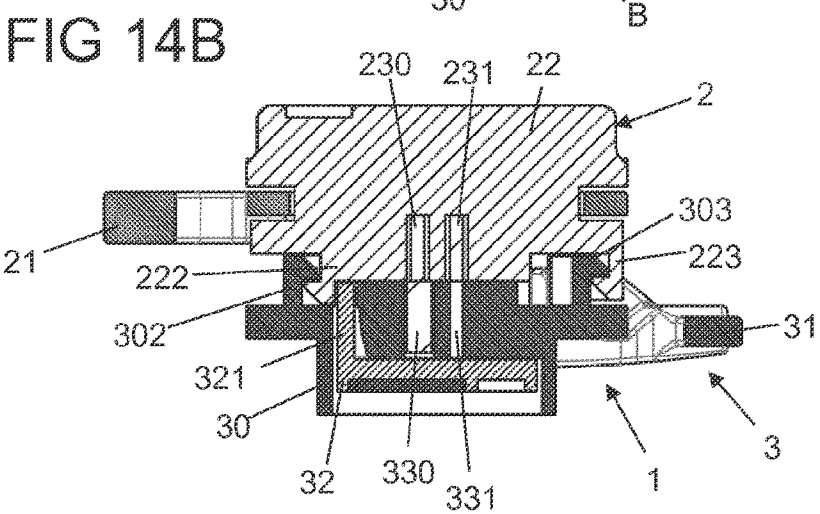
FIG. 14B shows a sectional view through the closure device as shown in FIG. 14A.
Figure 16:
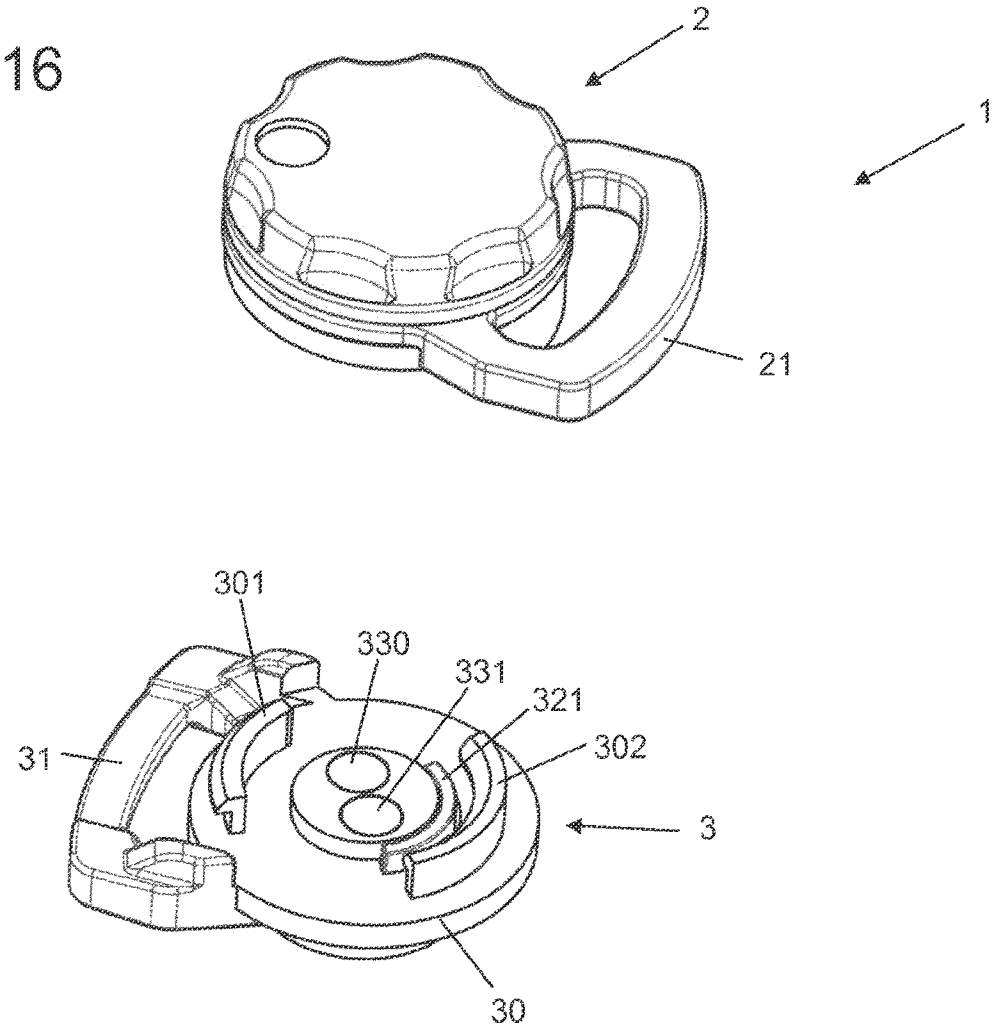
FIG. 16 shows a view of the closure device with closure parts separated from each other.

In an exemplary embodiment shown in FIGS. 14A, 14B to 16, the closure element 22 of the first closure part 2 on the other hand is rotatably arranged on a base body 20, which also comprises a belt attachment 21, and with a stationary base body 20 can be rotated relative to the base body 20 about an axis of rotation D in order to open the closure device 1, as this is shown in the transition from FIGS. 14A, 14B towards FIGS. 15A, 15B. When opening the closure device 1, the belt attachments 21, 31 of the first closure part 2 and of the second closure part 3 thus can remain in position relative to each other.

Otherwise, the mode of operation of the closure device 1 in particular for producing the positive connection on placement and for releasing is identical, as described above in particular with reference to FIGS. 7 and 8A to 8C. In particular with regard to the mode of operation of the locking portions 222, 223, 302, 303 and the blocking element 32 of the second closure part 3, reference therefore is made to the above explanations.

The idea underlying the solution is not limited to the exemplary embodiments described above, but can also be realized in principle in a completely different way.

A closure device as described above can be used as a belt buckle in a child seat for use in a vehicle or also as a belt buckle for perambulator. In particular such exemplary embodiments in which a plurality of second closure parts are to be connected to a first closure part can be used as multipoint attachments in multipoint belt systems.

However, such a closure device can also create a connection between two individual closure parts. Such a closure device can be used for example as a buckle in a helmet, for example a sports helmet, for example a ski helmet or a bicycle helmet. Such a closure device can, however, also be used for connecting entirely different assemblies to each other, for example as a closure for a bag, for example a school bag, or for attaching other parts to each other.

An actuating element for actuating a closure element of the first closure part or for jointly actuating a plurality of closure elements of the first closure part, as described, can be configured as a gear wheel or toothed rack. However, other actuating elements are also conceivable, for example in the form of a chain, a cable, a pushbutton, a connecting rod or a coulisse element, wherein a force deflection takes place to convert an actuating movement into a rotary movement of one or more closure elements.

LIST OF REFERENCE NUMERALS

1 closure device
2 first closure part

20 base body
200, 201 bearing opening
202 guideway
203 spring receptacle
21 belt attachment
22 closure element
220 base body
221 coupling portion (toothing)
222 locking portion
222A, 222B locking portion
223A, 223B locking portion
224 latching protrusion
225 run-up slope
23 magnetic device
230, 231 magnetic element
24 actuating element
240 body
241 collar
242 coupling portion (toothing)
243 shaft
244 spring element
245 supporting element
3 second closure part
30 base element
300 receiving space
301 lid element
302 locking portion
303 locking portion
304 latching protrusion
305 run-up slope
31 belt attachment
32 blocking element
320 head portion
321 blocking portion
322 magnetic element
33 magnetic device
330, 331 magnetic element
4 belt
A placement direction
B actuating direction
B1, B2 direction of rotation
D axis of rotation
E engagement direction

The invention claimed is:

1. A closure device, comprising a first closure part which includes a base body and at least one closure element rotatably arranged on the base body about an axis of rotation, wherein the at least one closure element includes a base body and at least one first locking portion arranged on the base body, and at least one second closure part, which includes a base element and at least one second locking portion arranged on the base element, wherein the first closure part and the least one second closure part can be placed against each other along a placement direction, wherein the first closure part and the at least one second closure part are placed against each other in a closed position such that the at least one first locking portion of the at least one closure element and the at least one second locking portion of the at least one second closure part are in engagement with each other, wherein for releasing the first closure part and the at least one second closure part from each other, the at least one first locking portion of the at least one closure element and the at least one second locking portion of the at least one second closure part can be brought out of engagement with each other by rotating the at least one closure element relative to the base body of the first closure part, wherein an actuating element is adjustably arranged on the base body, which is operatively connected to the at least one closure element in such a way that by displacing the actuating element relative to the base body, the at least one closure element is rotatable relative to the base body, and wherein the at least one closure element of the first closure part includes two first locking portions arranged on the base body of the at least one closure element on different sides of the axis of rotation, and the at least one second closure part includes two second locking portions, wherein in the closed position the first locking portions and the second locking portions are positively in engagement with each other.

2. The closure device according to claim 1, wherein the actuating element includes a coupling portion via which the actuating element is positively operatively connected to the at least one closure element.

3. The closure device according to claim 2, wherein the coupling portion is formed by a toothing.

4. The closure device according to claim 1, wherein the actuating element is linearly or rotationally adjustable relative to the base body along an actuating direction.

5. The closure device according to claim 1, wherein the at least one first locking portion is rigidly arranged on the base body of the at least one closure element and the at least one second locking portion is rigidly arranged on the base element of the at least one second closure part.

6. The closure device according to claim 1, wherein at least one of the at least one first locking portion protrudes from the base body along the axis of rotation, and the at least one first locking portion includes a first latching protrusion and the at least one second locking portion includes a second latching protrusion, wherein in the closed position the first latching protrusion and the second latching protrusion are positively held in engagement with each other.

7. The closure device according to claim 1, wherein the first locking portions each include a first latching protrusion, wherein the first latching protrusion of one of the first locking portions points radially to the inside and the first latching protrusion of the other one of the first locking portions points radially to the outside, wherein in the closed position the first latching protrusions each are in engagement with a second latching protrusion of an associated second locking portion of the at least one second closure part.

8. The closure device according to claim 1, wherein the at least one second closure part includes a blocking element with a blocking portion which in the closed position is arranged on a side of the at least one first locking portion facing away from the at least one second locking portion and blocks secures the engagement of the at least one first locking portion and the at least one second locking portion with each other.

9. The closure device according to claim 8, wherein at least one of in the closed position the blocking portion is arranged radially inside the at least one first locking portion, the blocking element is adjustable relative to the base element of the at least one second closure part, and the blocking element is magnetically pretensioned in the direction of a blocking position for securing the engagement of the at least one first locking portion and the at least one second locking portion with each other.

10. The closure device according to claim 1, wherein the at least one closure element includes at least one first magnetic element and the at least one second closure part includes at least one second magnetic element, wherein the at least one first magnetic element and the at least one second magnetic element are configured to cooperate in a magnetically attracting way on placement of the first closure part and the at least one second closure part against each other.

11. The closure device according to claim 1, wherein the first closure part includes resetting means for resetting the actuating element into a starting position associated to the closed position.

12. A closure device, comprising:

a first closure part which includes a base body and at least one closure element rotatably arranged on the base body about an axis of rotation, wherein the at least one closure element includes a base body and at least one first locking portion arranged on the base body, and at least one second closure part, which includes a base element and at least one second locking portion arranged on the base element, wherein the first closure part and the least one second closure part can be placed against each other along a placement direction, wherein the first closure part and the at least one second closure part are placed against each other in a closed position such that the at least one first locking portion of the at least one closure element and the at least one second locking portion of the at least one second closure part are in engagement with each other, wherein for releasing the first closure part and the at least one second closure part from each other, the at least one first locking portion of the at least one closure element and the at least one second locking portion of the at least one second closure part can be brought out of engagement with each other by rotating the at least one closure element relative to the base body of the first closure part, wherein an actuating element is adjustably arranged on the base body, which is operatively connected to the at least one closure element in such a way that by displacing the actuating element relative to the base body, the at least one closure element is rotatable relative to the base body, and wherein the at least one closure element has a first side and a second side, wherein on the first side and on the second side at least one first locking portion each is arranged, wherein one second closure part each can be placed against the first side and against the second side.

13. A closure device, comprising a first closure part which includes a closure element with a base body and at least one first locking portion arranged on the base body, and a second closure part, which includes a base element and at least one second locking portion arranged on the base element, wherein the first closure part and the second closure part can be placed against each other along a placement direction, wherein in a closed position the first closure part and the second closure part are placed against each other such that the at least one first locking portion of the closure element and the at least one second locking portion of the second closure part are in engagement with each other, wherein for releasing the first closure part and the second closure part from each other, the at least one first locking portion of the closure element and the at least one second locking portion of the second closure part can be brought out of engagement with each other by rotating the closure element relative to the second closure part about an axis of rotation, and wherein the closure element has a first side and a second side, wherein on the first side and on the second side at least one first locking portion each is arranged, wherein one second closure part each can be placed against the first side and against the second side.

14. The closure device according to claim 13, wherein the closure element includes at least one first magnetic element and each second closure part includes at least one second magnetic element, wherein the at least one first magnetic element and the at least one second magnetic element are configured to cooperate in a magnetically attracting way on placement of each second closure part against the first closure part.

15. The closure device according to claim 13, wherein the second closure part to be placed against the first side of the closure element and the second closure part to be placed against the second side of the closure element are identical in construction.

* * * * *